US009022113B2

(12) United States Patent
Rex et al.

(10) Patent No.: US 9,022,113 B2
(45) Date of Patent: May 5, 2015

(54) ONE TRIP CASING OR LINER DIRECTIONAL DRILLING WITH EXPANSION AND CEMENTING

(75) Inventors: Ines Rex, Lehrte-Arpke (DE); Joerg Lehr, Celle (DE); Keven O'Connor, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 429 days.

(21) Appl. No.: 13/467,509

(22) Filed: May 9, 2012

(65) Prior Publication Data

US 2013/0299169 A1 Nov. 14, 2013

(51) Int. Cl.
*E21B 33/14* (2006.01)
*E21B 7/20* (2006.01)

(52) U.S. Cl.
CPC ..... *E21B 7/20* (2013.01)

(58) Field of Classification Search
CPC ..... E21B 7/20
USPC ..... 166/285, 202.06, 202.07, 177.4, 216, 166/217, 206, 207; 175/257, 171, 385, 406
See application file for complete search history.

(56) References Cited

U.S. PATENT DOCUMENTS

| | | | | |
|---|---|---|---|---|
| 5,348,095 | A | 9/1994 | Worrall et al. | |
| 5,794,702 | A * | 8/1998 | Nobileau | 166/380 |
| 5,845,722 | A | 12/1998 | Makohl et al. | |
| 6,196,336 | B1 | 3/2001 | Fincher et al. | |
| 6,253,850 | B1 | 7/2001 | Nazzai et al. | |
| 6,371,203 | B2 | 4/2002 | Frank et al. | |
| 6,419,033 | B1 | 7/2002 | Hahn et al. | |
| 6,446,724 | B2 | 9/2002 | Baugh et al. | |
| 6,543,552 | B1 | 4/2003 | Metcalfe et al. | |
| 6,854,533 | B2 | 2/2005 | Galloway et al. | |
| 7,114,559 | B2 | 10/2006 | Sonnier et al. | |
| 7,128,146 | B2 | 10/2006 | Baugh et al. | |
| 7,383,889 | B2 | 6/2008 | Ring et al. | |
| 7,784,552 | B2 | 8/2010 | Brouse | |

(Continued)

FOREIGN PATENT DOCUMENTS

WO WO 2011044012 A1 * 4/2011 ..... E21B 7/00

OTHER PUBLICATIONS

Stockmeyer, Carl F., et al., "Expanable-Drilling-Liner Technology: First Commercial Deployment of a Monobore Liner Expansion", SPE 108331. Sep. 2007, 1-10.

(Continued)

*Primary Examiner* — Kenneth L Thompson
*Assistant Examiner* — David Carroll
(74) *Attorney, Agent, or Firm* — Steve Rosenblatt

(57) ABSTRACT

A tubular string is advanced with a bottom hole assembly as the hole is drilled and reamed in a desired direction with the aid of directional drilling equipment adjacent the bit. When the advanced tubular forms the desired lap to the existing tubular, the assembly can be configured to cement the tubular and expansion can then be accomplished to fill the annular space and enhance the cement bonding. The expansion equipment can create a bottom bell on the expanded tubular and expand the top end into a bell of the existing tubular so that a monobore is created as the process is repeated with each added string. Numerous variations are contemplated for each single trip including but not limited to the direction of expansion, whether cementing or expansion occurs first, reforming folded tubing in the hole as well as the nature of the expansion tool and pressure control when drilling.

18 Claims, 12 Drawing Sheets

(56) References Cited

U.S. PATENT DOCUMENTS

| | | | | |
|---|---|---|---|---|
| 7,861,779 | B2 | 1/2011 | Vestavik et al. | |
| 8,132,619 | B2 | 3/2012 | Smith, Jr. et al. | |
| 2002/0040787 | A1 | 4/2002 | Cook et al. | |
| 2002/0189863 | A1 | 12/2002 | Wardley | |
| 2003/0056991 | A1 | 3/2003 | Hahn et al. | |
| 2003/0106688 | A1 | 6/2003 | Saugier | |
| 2003/0132032 | A1* | 7/2003 | Metcalfe et al. | 175/57 |
| 2004/0011534 | A1* | 1/2004 | Simonds et al. | 166/384 |
| 2004/0079528 | A1* | 4/2004 | Metcalfe et al. | 166/297 |
| 2005/0121203 | A1* | 6/2005 | Richard et al. | 166/380 |
| 2005/0126825 | A1 | 6/2005 | Moriarty et al. | |
| 2006/0005973 | A1* | 1/2006 | Harrall et al. | 166/384 |
| 2006/0196663 | A1 | 9/2006 | Keller | |
| 2006/0272807 | A1 | 12/2006 | Adam et al. | |
| 2007/0068703 | A1 | 3/2007 | Tessari et al. | |
| 2007/0144784 | A1* | 6/2007 | Head et al. | 175/57 |
| 2007/0175665 | A1 | 8/2007 | Tessari et al. | |
| 2007/0267221 | A1 | 11/2007 | Giroux et al. | |
| 2007/0287603 | A1 | 12/2007 | Norris et al. | |
| 2008/0135289 | A1 | 6/2008 | Ford | |
| 2008/0264690 | A1* | 10/2008 | Khan et al. | 175/25 |
| 2009/0056938 | A1 | 3/2009 | Treviranus et al. | |
| 2009/0090508 | A1 | 4/2009 | Brouse | |
| 2009/0107675 | A1 | 4/2009 | Eriksen et al. | |
| 2010/0032167 | A1 | 2/2010 | Adam et al. | |
| 2010/0116490 | A1* | 5/2010 | Lynde et al. | 166/250.01 |
| 2011/0061939 | A1 | 3/2011 | Boyle | |
| 2011/0114336 | A1 | 5/2011 | Lehr et al. | |
| 2011/0265941 | A1 | 11/2011 | Jiral et al. | |
| 2012/0061097 | A1 | 3/2012 | O'Connor et al. | |
| 2012/0186816 | A1* | 7/2012 | Dirksen et al. | 166/297 |

OTHER PUBLICATIONS

Stockmeyer, C.F., et al., "Development and Commercial Deployment of an Expandable Monobore Liner Extension", SPE 102150, Sep. 2008, 1-14.

Coronado, Martin P., et al., "Development of a One-Trip ECP Cement Inflation and Stage Cementing System for Open Hole Completions" IADC/SPE 39345, Mar. 1998, 473-481.

Stockmeyer, Carl F., et al., Expandable Monobore Drilling Liner Extension Technology: Applications and Implementations following the First Commercial Introduction and Development:, SPE 113901, Jun. 2008, 1-13.

* cited by examiner

ONE TRIP CASING OR LINER DIRECTIONAL DRILLING WITH EXPANSION AND CEMENTING

FIELD OF THE INVENTION

The field of the invention is generally drilling and completion optimization and more specifically the combination of multiple functions in a single trip such as liner or casing directional drilling with cementing and expansion capabilities to form a monobore.

BACKGROUND OF THE INVENTION

Drilling a hole and advancing casing or liner as the hole is drilled and reamed are known as described in U.S. patent and published applications: U.S. Pat. Nos. 5,845,722; 6,196,336; 6,419,033; 2003/0056991; 2003/0106688; U.S. Pat. Nos. 5,348,095; 6,371,203; 2002/0040787; 2002/0189863; 2004/0011534; 2005/6854533; 2007/0144784; 2007/0175665; 2007/0267221; 2008/0135289; 2009/0090508 and 2010/7784552.

Some of the art also has a focus on hole orientation while drilling such as US Publication 2009/0056938 and 2005/0126825. Casing drilling with expansion is discussed in US Publication 2007/7287603. Other prior art discusses drilling a wellbore and forming a monobore, such as US Publication 2006/0196663; 2011/0114336; 2010/0032167 and 2008/7383889. Drilling and cementing is discussed in UP Publication 2009/0107675. Expanding and cementing is covered in US Publication 2012/0061097. Using folded tubulars and reforming them in a wellbore coupled with further expansion as a possibility is discussed in 2011/0265941.

The present invention seeks to make drilling and completion more efficient by enabling in some embodiments the drilling and reaming of a borehole while advancing casing, liner or a patch with the further ability to expand and cement in either order. The expansion device can be run top down or bottom up when using a swage that can be built to multiple diameters for creating a bottom bell on the tubular advanced with the bottom hole assembly (BHA), expand the tubular and fixate the tubular to an existing tubular through which the expanded tubular has just been run. Cementing can be accomplished before or after expansion and expansion can be accomplished with an inflatable instead of a swage. A monobore can be created with an expansion tool that adapts to several diameters. The BHA can be driven by a fluid motor such as a Moineau pump and supported by rigid or coiled tubing. The tubular can be solid, with single or multiple walls or slotted 101. The swage can be advanced with a hydraulic anchor/stroker tool alone or with force delivered through the running string or combinations of the two. Steering tools can be incorporated in the BHA as well as sensors to determine the location of the string being advanced. Drilling pressure at the bit can be controlled with adjustable chokes associated with the tubular being drilled in. The swage can be used as a tubular support during running in and drilling. A folded liner can be advanced and then made round with a swage or by application of internal pressure. The string can be rotated during cementing to distribute cement with the downhole motor to do the rotation if coiled tubing is used for the running string. Expansion can also be accomplished with roller expanders, conical swages or internal pressure in the string. Expansion direction can be top down or bottom up. Cementing can occur bottom up or top down and can occur before or after expansion. Expansion can also occur at one end or another first and then proceed from the opposite end or with a middle section expanded first followed by opposed ends. Top down expansion can be aided by adding string weight by setting down weight at the surface. Those skilled in the art will better appreciate these and other aspects of the present invention from a review of the detailed description of the preferred embodiment and the associated drawings while recognizing that the full scope of the invention is to be found in the appended claims.

SUMMARY OF THE INVENTION

A tubular string is advanced with a bottom hole assembly as the hole is drilled and reamed in a desired direction with the aid of directional drilling equipment adjacent the bit. When the advanced tubular forms the desired lap to the existing tubular, the assembly can be configured to cement the tubular and expansion can then be accomplished to fill the annular space and enhance the cement bonding. The expansion equipment can create a bottom bell on the expanded tubular and expand the top end into a bell of the existing tubular so that a monobore is created as the process is repeated with each added string. Numerous variations are contemplated for each single trip including but not limited to the direction of expansion, whether cementing or expansion occurs first, reforming folded tubing in the hole as well as the nature of the expansion tool and pressure control when drilling.

DETAILED DESCRIPTION OF THE PREFERRED EMBODIMENT

Figure 1:
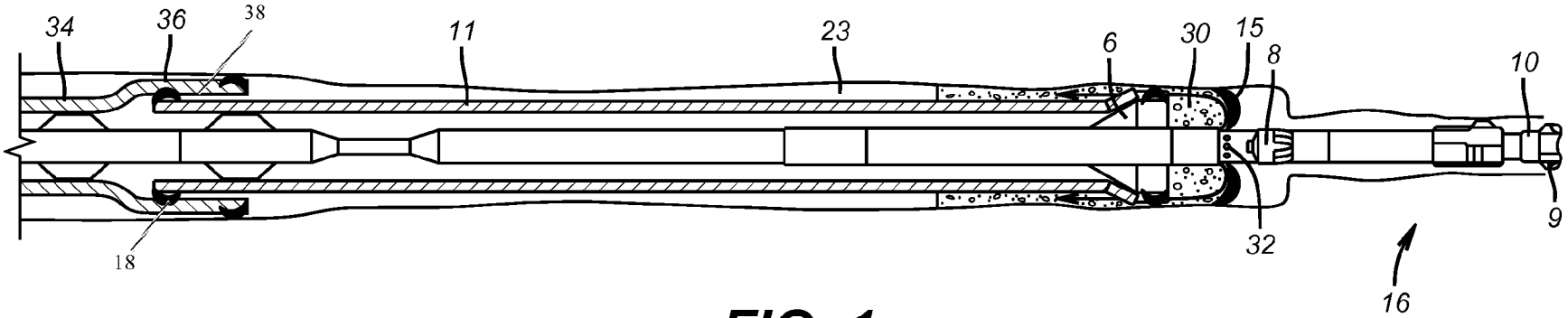
FIG. 1 is an assembly drawing of the system of the present invention using a mechanical swage.
Figure 2:
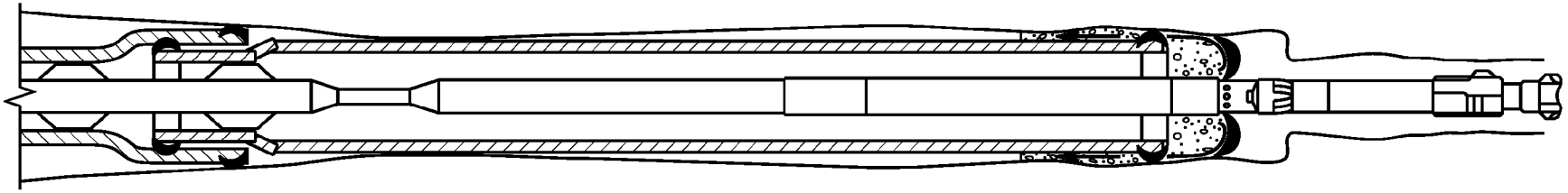
FIG. 2 is an alternative to FIG. 1 using internal pressure to accomplish expansion rather than a swage assembly.
Figure 3:
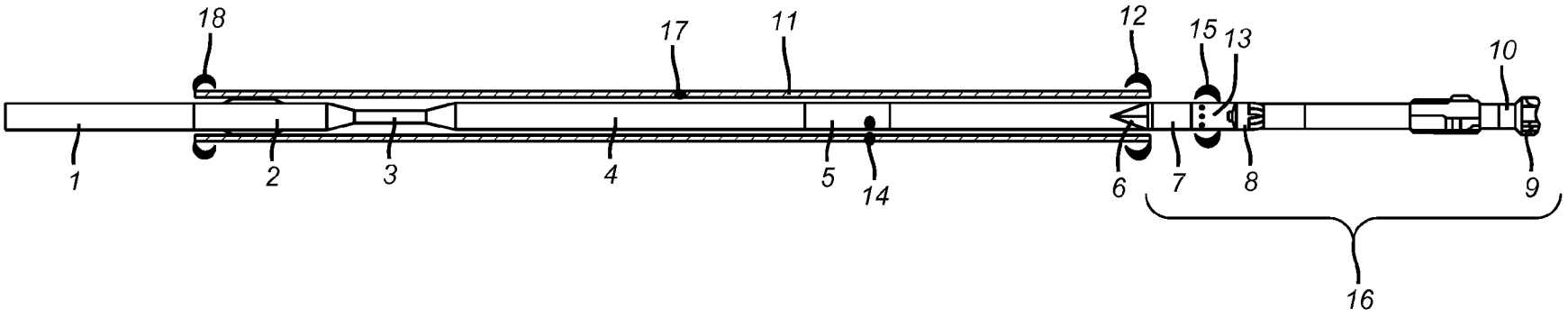
FIG. 3 is another view of the assembly of FIG. 1.

Referring to FIGS. 1 and 3, the bottom hole assembly (BHA) 16 has a pilot bit 9 and steering unit 10 that are spaced apart from an expandable reamer 8. Continuing in the uphole direction there is a stroker/thruster 7 which is a hydraulically actuated piston that works in tandem with an anchor 1 to selectively move the swage assembly 6 through the casing or liner 11. A running tool 2 selectively retains the tubular 11 for running in and drilling so that tubular 11 moves with the advancing bit 9. The running tool 2 is connected through drill pipe 3 to a mud motor 4 for rotation of the bit 9. The entire assembly is supported from the surface with rigid or coiled tubing that is not shown. An indication tool 5 is part of the tool string for drilling and senses an indication point 14 on the tubular 11 to properly align the internal components with the surrounding tubular 11 for actuation of the running tool to connect them together so that there will be tandem movement of the advancing bit 9 and the tubular 11. Below the expander 6 is cement valve 13 which is selectively opened when and if it is desired to cement. This ported sub is normally closed so that fluid from the surface can be used to extend the blades on the reamer 8 and provide nozzle fluid to the pilot bit nozzles to remove cutting as more hole is made by bit 9. Working in association with the cement valve assembly 13 is the open hole packer 15 that is preferably a cup type seal that opens in an uphole direction to redirect cement 24 by opening up as shown in FIG. 1. This type of seal can be multiple rows of overlapping metals that can slide relatively to each other as the delivered cement 24 exits from ports 32. Such ports 32 can be opened with a dropped ball on a seat that shifts a sleeve (not shown) or internal pressure levels through an orifice that shifts a sleeve using differential pressure or other mechanisms to selectively open the ports 32 at the onset of cementing. The ports 32 can also be configured with one way valves to prevent return of the delivered cement 24 once it passes through the ports 32.

FIG. 1 also shows the existing tubular 34 that preferably has a bell 36 formed at its lower end so that the tubular 11 can be expanded into bell 36 for a sealed connection between the two so that a monobore can be created as the process is repeated with additional tubulars 11. As will be explained below the swage assembly or expander 6 can be built to different dimensions so that the onset of movement through the tubular 11 is at a larger dimension for the expander 6 to create the bell 36 as is shown more clearly in FIG. 11. Note that the anchor 1 grips tubular 34 above the bell 36 to enable the stroker 7 to advance the swage assembly 6 through the tubular 11. As an alternative the swage assembly 6 can be advanced with a pulling force on the drill string (not shown) and the stroker 7 and anchor 1 can be part of the assembly for backup purposes only.

The open hole packer 15 is there to keep the cement 24 from moving downhole toward the reamer 8 and the bit 9. Low pressure open hole packer 12 is secured to the lower end of the tubular 11 and is there for the purpose of preventing cement 24 backup out of the annular space 38 as an alternative to check valves associated with openings 32. The packer 12 can also be of the multi-layered cup shape petal design where the petals move relatively to each other to open. Cement delivery merely displaces the cup shape inwardly as the cement 24 passes and thereafter the weight of the cement above the packer 12 urges its overlapping layers outwardly so that the cement 24 is prevented from reversing direction.

At the top of the tubular 11 and extending into the annular space 38 is a schematically illustrated choke that can be used to control the fluid pressure at the bit 9 when more hole is made within a desired pressure range to enhance the rate of penetration and to minimize formation damage. Alternatively, such pressure control at the bit 9 could also be accomplished at the well surface.

Figure 4:
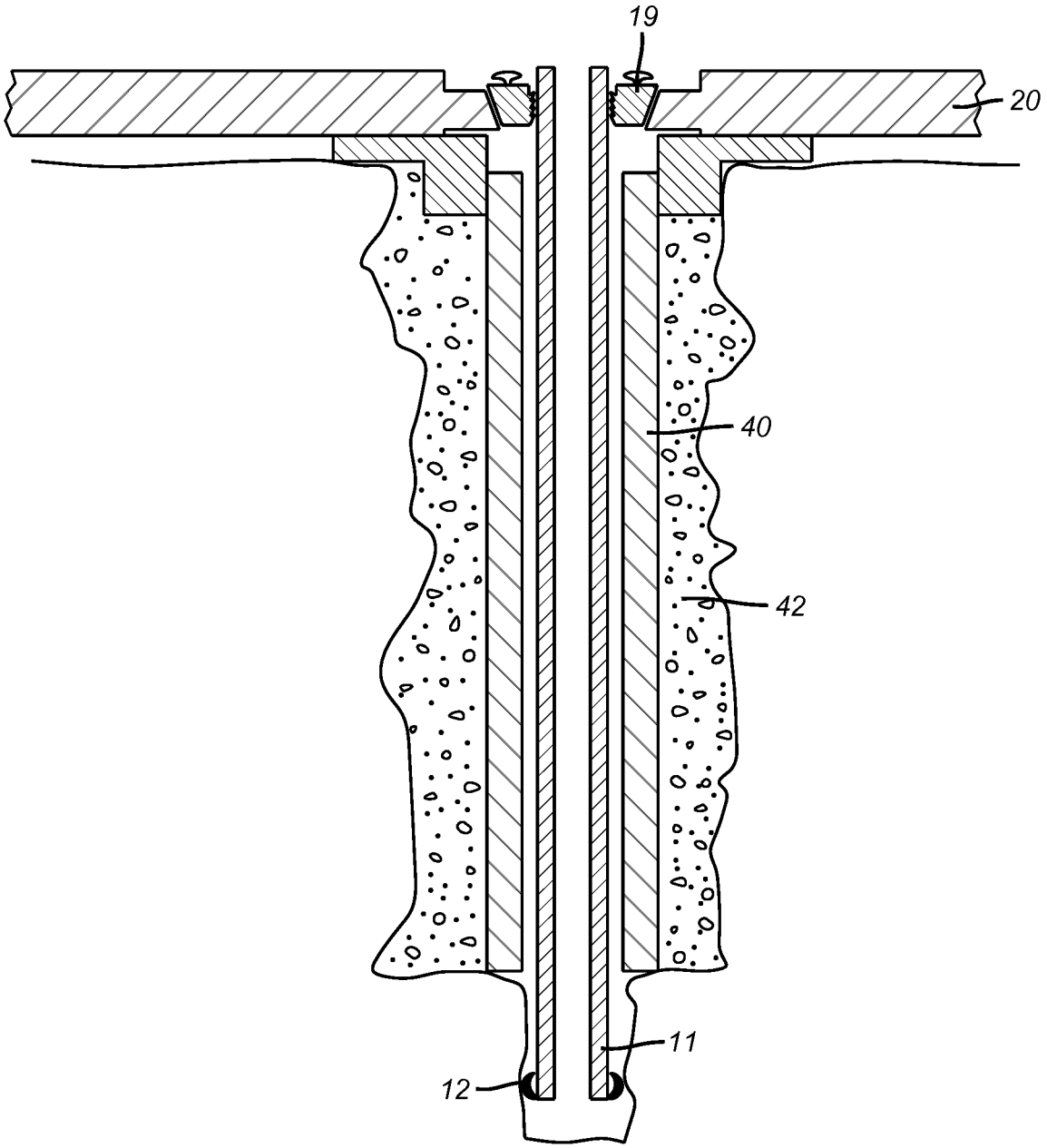
FIG. 4 shows a tubular to be run in suspended from the surface.
Figure 5:
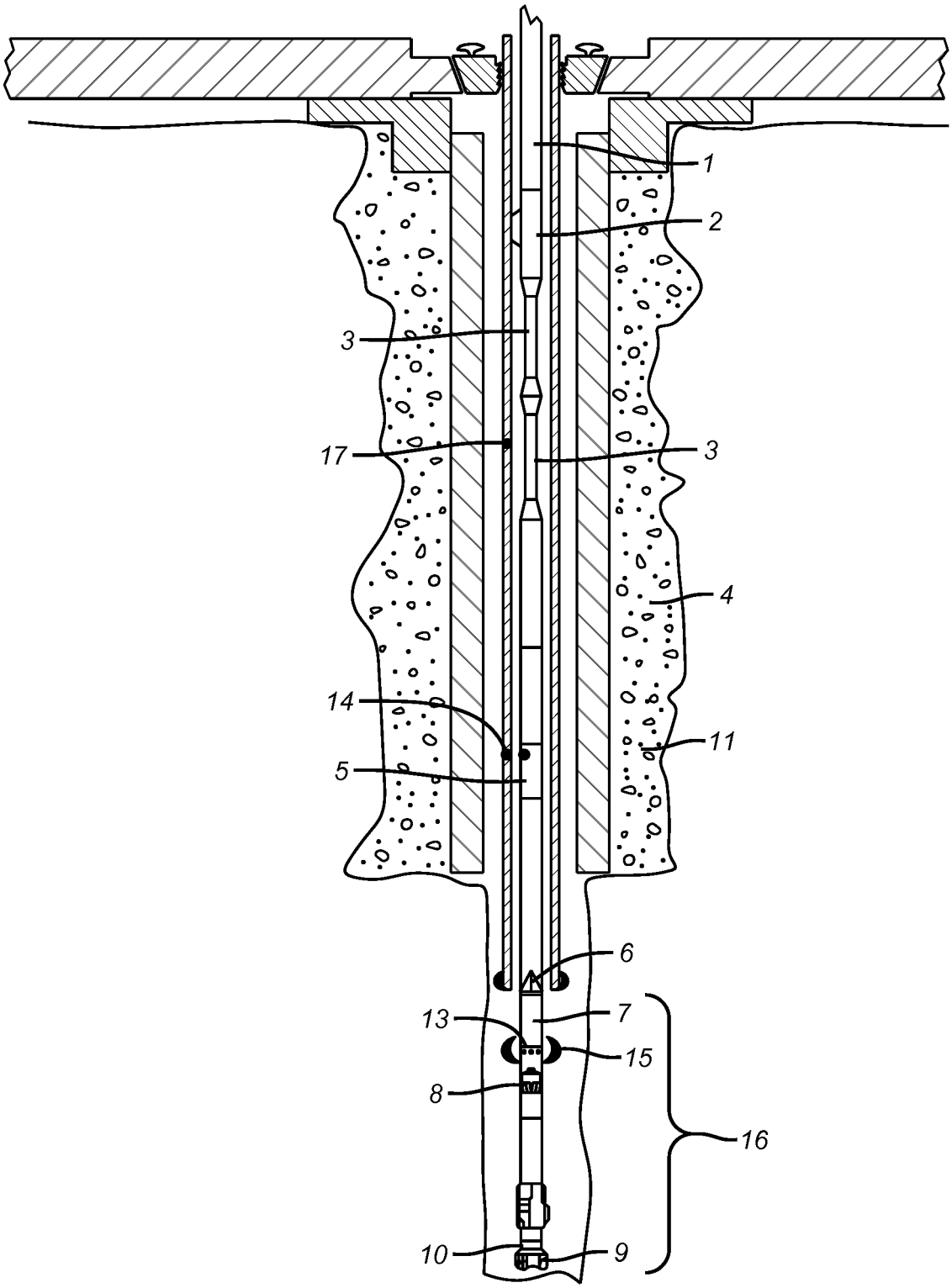
FIG. 5 is the view of FIG. 4 with the bottom hole assembly extended through the tubular to latch the tubular to the BHA.
Figure 6:
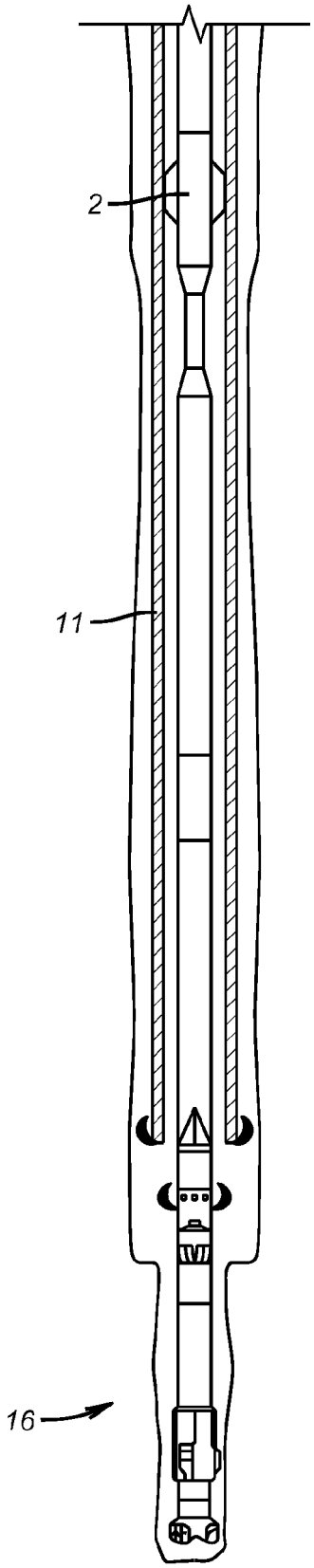
FIG. 6 is the view of FIG. 5 with the assembly advanced to hole bottom.
Figure 7:
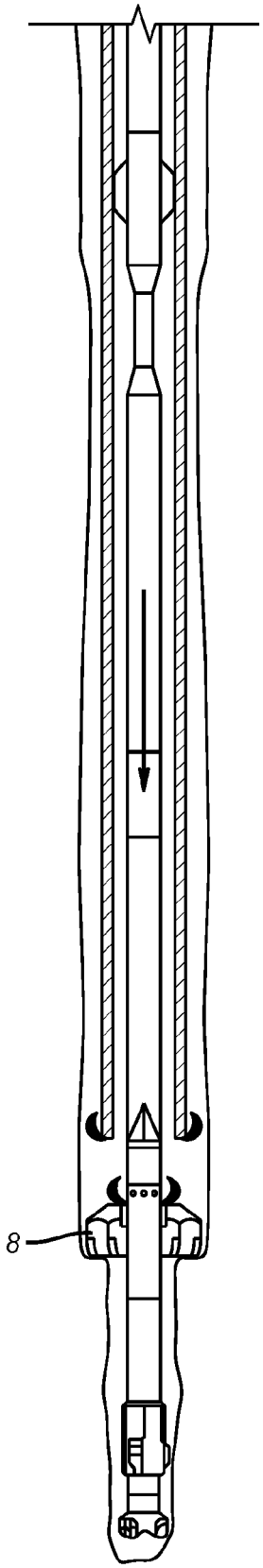
FIG. 7 is the view of FIG. 6 with the reamer extended.

The major components of the assembly having been described a preferred sequence of operation will now be reviewed followed by possible variations and other options. FIG. 4 illustrates the rig floor 20 with slips 19 holding the casing or liner sting 11 inside an existing tubular 40 that has been cemented with cement 42. Packer 12 is shown at the lower end of the tubular string 11. In FIG. 5 the BHA 16 is installed so that the anchor 1 extending out beyond the top of the tubular string 11. The indication tool 5 senses the indication point 14 to get this needed alignment. In FIG. 6 the running tool 2 is actuated to grab the tubular string 11 so that the slips 19 at the rig floor 20 can be released and the drill string (not shown) can be used to support the tubular string 11. The bit can then be run to hole bottom, if it is not already there.

Figure 8:
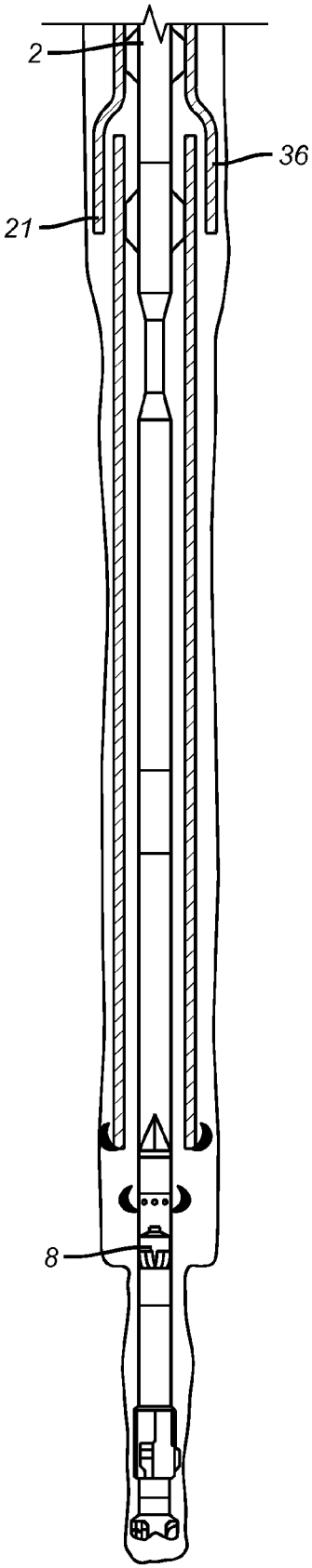
FIG. 8 is the view of FIG. 7 with the desired lap obtained, the reamer collapse and the anchor set to attach the assembly to the existing tubular.
Figure 9:
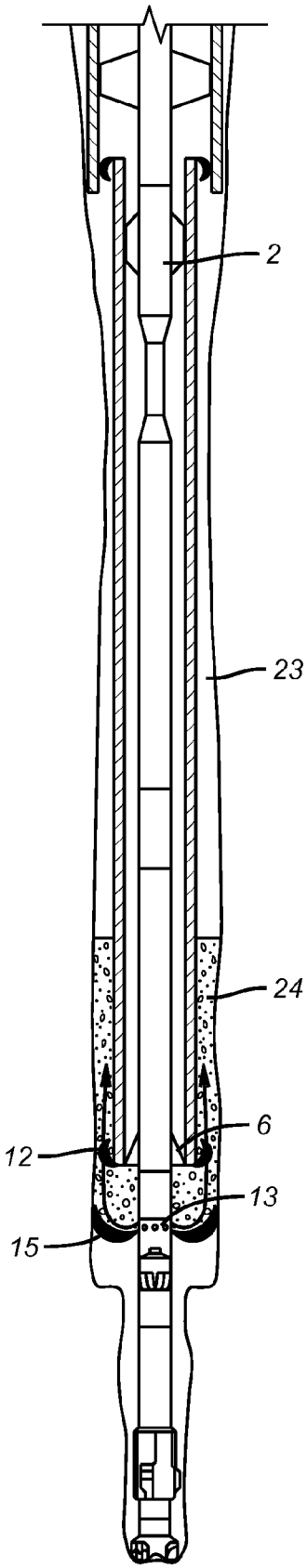
FIG. 9 is the view of FIG. 8 showing cement delivery and expansion.

FIG. 8 shows the reamer 8 with blades extended which can be accomplished by the circulating fluid pressure that is directed to the nozzles of the bit 9. At this point drilling with bit 9 can take place while reaming with reamer 8 and advancing the tubular string 11 at the same time. In FIG. 9 the drilling has advanced the tubular string so that its top end overlaps the lower end 21 at bell 36. The anchor 1 is activated above the bell 36 and the reamer is deactivated so that expansion or cementing, if desired, can now take place.

In FIG. 9 the expander 6 is built and moved into contact with the lower end of the tubular string 11 to close it off from the cement 24 that is delivered through the now opened cement valve 13. Delivery of the cement 24 opens up the open hole packer 15 so that the cement is redirect up into the annulus 23 in the direction of the arrows. At this time the open hole packer 12 also opens under the weight of the delivered cement 24 to keep the cement 24 from reversing direction and going back toward cement valve 13. The running tool 2 can now be released.

Figure 10:
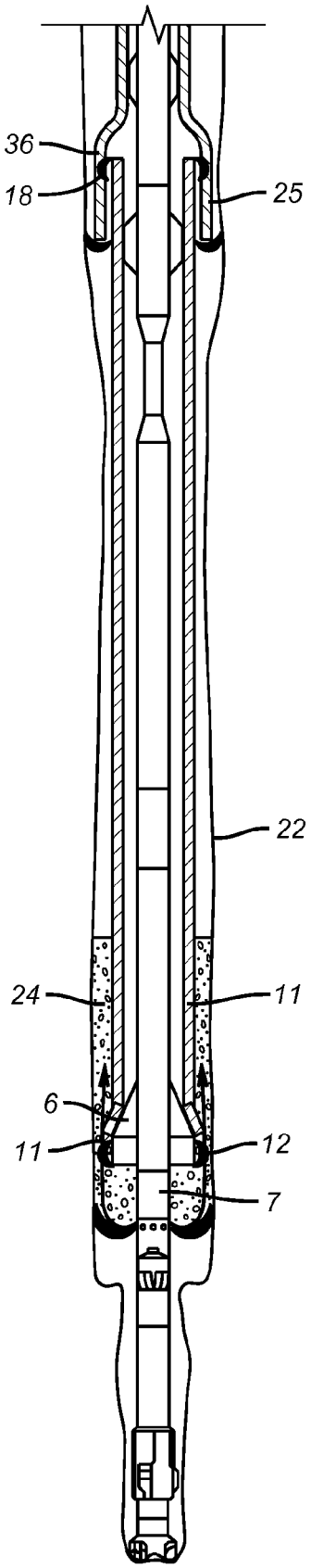
FIG. 10 is the view of FIG. 9 showing expansion that makes the annular space smaller and redistributes the cement.
Figure 11:
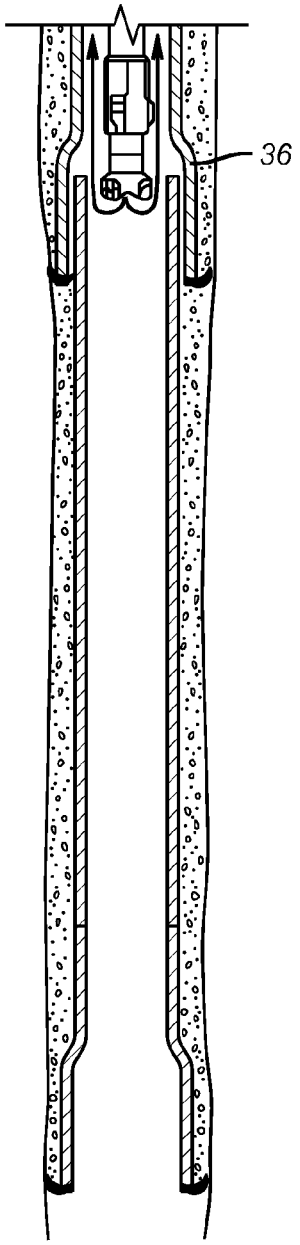
FIG. 11 is the view of FIG. 10 showing expansion at the lap to the existing liner to connect them followed by circulation to remove excess cement.

FIG. 10 shows the swage 6 making the bell 36 at the lower end of the tubular string 11 followed by being reconfigured to expand the balance of tubular string 11 to the desired diameter so that the recess shoe gap 25 will close when the swage assembly 6 gets to that location. The measured amount of cement 24 is pushed uphole in the annulus 23 as the annulus 23 gets smaller due to the tubular string 11 expansion toward the borehole wall 22. The packer 12 is active to keep the cement 24 from moving downhole. A caliper log (not shown) can be used in conjunction with the cement delivery step. Preferably the expansion of the tubular string 11 moves the cement 24 to or through the recess shoe gap 25 which is then closed with the expander 6 against the bell 36. The adjustable choke 18 can then serve as a seal for gap 25 or some other sealing member or a metal to metal contact can then seal the tubular string 11 to the tubular above such as 40 or a previously expanded tubular string. FIG. 11 shows the end of the swaging and the removal of the BHA 16 while using fluid circulated through the bit 9 in the vicinity of the upper end of the tubular string 11 now joined to the tubular above to remove excess cement that got through the gap 25 before that gap was closed by the swage assembly 6. The assembly is then pulled out of the hole and a new tubular string is made ready and the process is repeated. If there is still cement in the tubular string 11 near the former gap 25 that is now closed, the bit 9 will simply drill through it.

Figure 12:
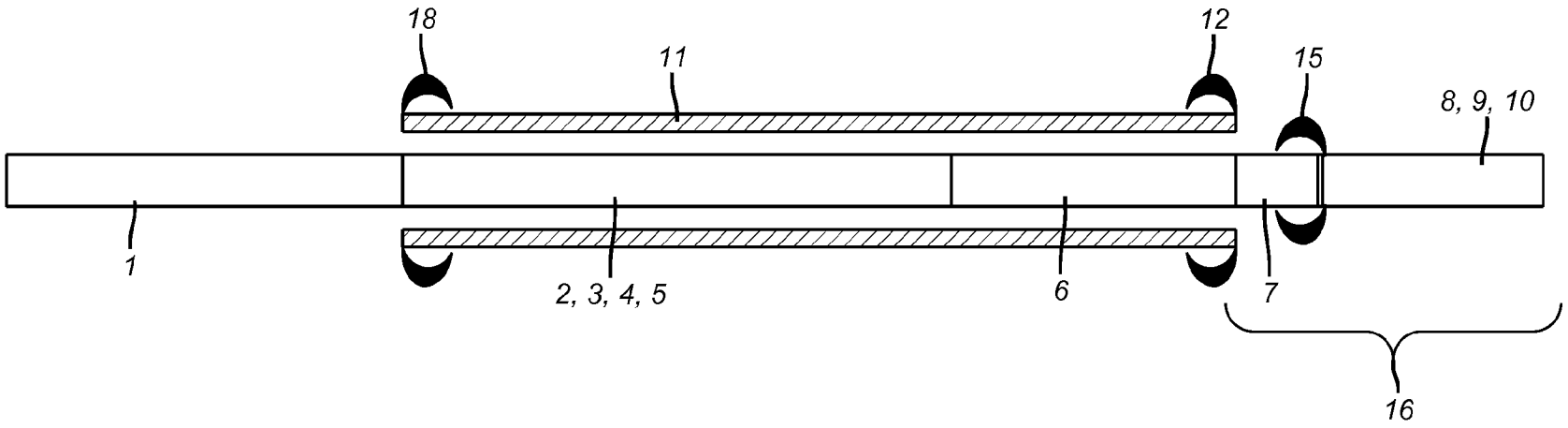
FIG. 12 schematically illustrates the bottom up expansion configuration.
Figure 13:
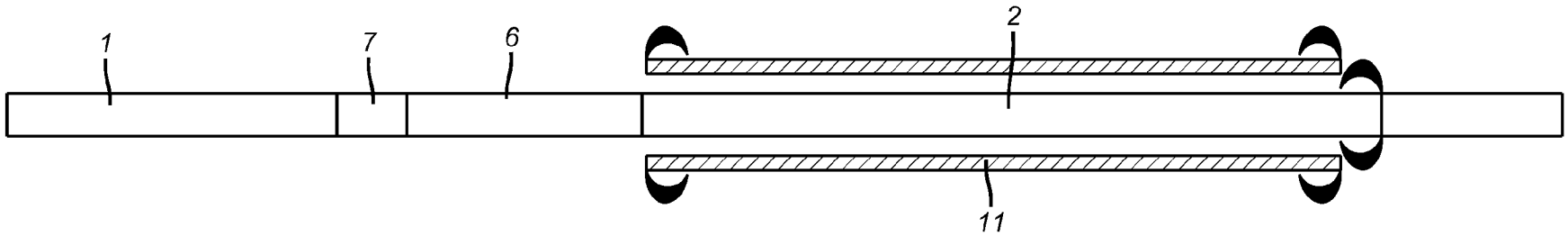
FIG. 13 schematically illustrates the top down expansion configuration.
Figure 14:
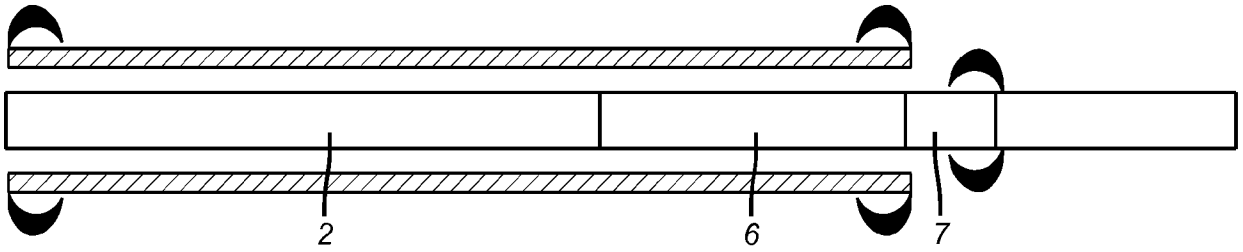
FIG. 14 is an alternative to FIG. 12 where the string is pulled to expand with the stroking tool available for backup purposes only.

FIGS. 12 and 13 illustrate the tool arrangement for bottom up and top down respectively. As previously described for bottom up, the running tool 2 and the associated components grab the tubular string 11 with the anchor 1 located above the running tool 2 and the swage 6 and thruster 7 located near the lower end. To do top down requires the running tool 2 to be below the expander 6 with the anchor 1 and the stroker 7 and the expander 6 above as shown in FIG. 13. As soon as tubular string 11 is affixed to the bell of the string above, the running tool 2 can release the tubular string 11. It should be noted that the initial expansion may or may not fully seal to the bell 36 of the string above depending if there is to be a cementing step thereafter. Gaps can be left open and then closed with the expander after cement 24 delivery. Expanding top down also reduces risk of getting stuck as the BHA is more easily pulled out with a tensile force on the drill string without any need to collapse the expander 6 as it is being driven top down in FIG. 13. As another alternative in FIG. 14, the expander 6 and thruster 7 can be located below the running tool 2 and the expansion can take place bottom up with a pulling force on the drill string (not shown) with the thruster 7 being there for backup purposes in the event excessive force would otherwise have to be applied to advance the expander 6. Normally in the bottom up expansion the stroker 7 advances the expander 6 while the drill string with anchor 1 is braced against the existing tubular above. When the tubular string 11 is secured to the existing string, then the running tool 2 is released. This allows the drill string with the bit 9 to then be removed. Alternatively for bottom up expansion the tubular string 11 can have a hanger near its lower end to hold it in place as the expander 6 is built to the desired expansion diameter the expander 6 moved with the stroker 7 through the tubular string 11. Alternatively the fixation can be at the lower end of the tubular string 11 and the expansion accomplished with a pulling force on the drill string (not shown).

The assembly can also be centered using an inflatable in the recently reamed section before building the expansion assembly 6.

In a top down expansion the chances of getting the expander 6 stuck are reduced as the expander 6 can be reconfigured to a smaller dimension and simply pulled out of the tubular string 11 or it can be retracted without having its swaging dimension reduced first. Top down also affords the option of building the expander 6 outside the tubular string 11 to the initial desired dimension. Again, extraction of the expander 6 with top down is far simpler than a bottom up expansion.

The expander 6 is preferably buildable to multiple dimensions so that it can make an end bell for a monobore completion and then be reconfigured to the desired dimension for completion of the expansion of the tubular string 11.

The open hole packer 12 can serve the function of a hanger. The drill string can be rigid pipe or coiled tubing. Alternatively the bit 9 can be attached to the tubular string 11 directly when the tubular string happens to be casing. The expansion process can also be initiated and monitored with sensors to detect the proper positioning of the tubular string 11 with respect to the existing tubular to which it will be attached by expansion and the sensors can monitor the progress of the expansion to determine when it is time to reconfigure the expansion assembly 6 after the tubular sting 11 is attached to the existing tubular above. The tubular string can be solid wall or slotted to facilitate the expansion.

The bypass 17, see FIG. 3 along with the adjustable choke 18 can work together with the choke 18 bypassing pressure in both directions with additional bypass flow through 17 for control of the effective density on the formation at the bit 9 taking into account the pressure drop in the annulus above.

The expander 6 when placed below the tubular string 11 for running in can support the tubular string 11 for running in the hole before drilling resumes.

Figure 15:
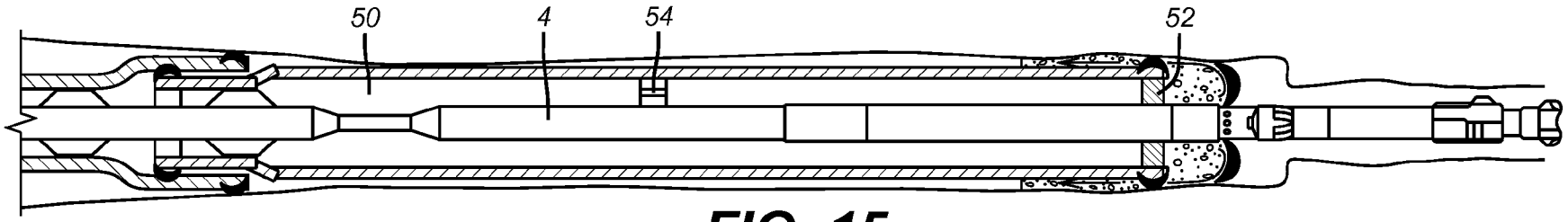
FIG. 15 illustrates expansion of the tubular with internal pressure.
Figure 21:
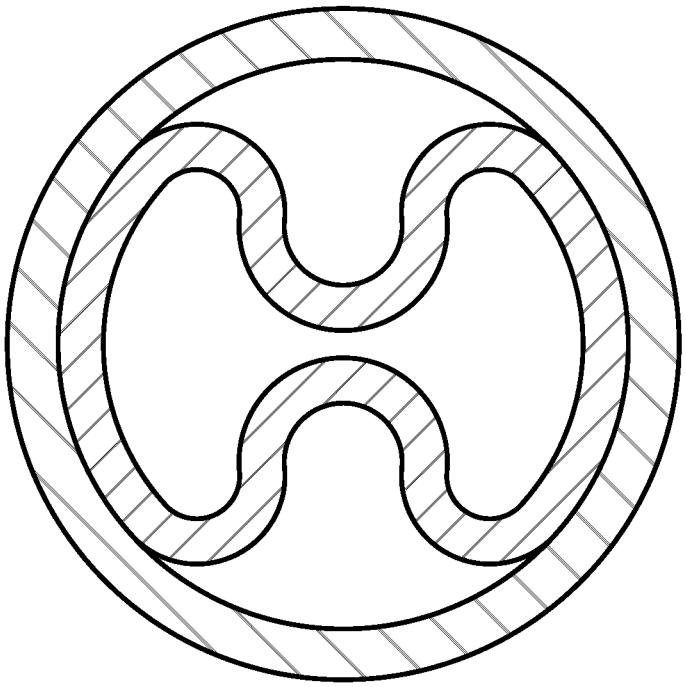
FIG. 21 shows one way of folding the tubular for run in before expansion into a rounded shape.

The tubular string need not have a circular cross section when running in. It can be fluted, as in FIG. 21 or flat and then when located at a desired location can be made round and subsequently further increased in a mechanical expansion with the expander 6. A higher expansion ratio can be attained with a folded string. Internal pressure can be used to unfold the string and bring its profile to round as shown in FIG. 15 with the internal volume 50 pressurized against a seal 52. Roller expanders can also be used for reforming the folded tubular or a combination of the above described techniques. The folder tubular string 11 can be expanded top down and the cement can be delivered top down through the gap such as 25 in FIG. 10. Bottom up expansion of the folded tubular string is also contemplated. Either end can be expanded first to make a bell and then the rest of the folded string can be expanded to a different dimension by going in either direction. Alternative a middle portion of the tubular string 11 can be expanded first for fixation followed by expansion of the bottom portion and then the top portion or vice versa.

Those skilled in the art will appreciate that the present invention allows for tubular sting expansion in the context of liner drilling with a drill string or with a casing drilling application. A monobore or some other type of completion can be achieved. In some applications cementing would be optional. Cementing can be done before or after expansion and in the same trip. The drilling can be steerable so that liner and casing can be advanced into a properly oriented bore and expanded and if desired cemented in the same trip. In some applications such as when setting a patch the cement can be allowed to flow toward the bit and the reamer. Expansion that takes place after cementing increases the cement bond and saves money by reducing the amount of cement needed for the completion. In some applications the cementing can be optional, which saves additional sums. Expansion increases the internal tubular diameter to allow greater flow capacities and less pressure drop for a given flow rate. Future drilling out of the cement such as when making a lateral can also be reduced when expansion results in a thinner layer of cement in the surrounding annulus. Use of known components of known integrity can be used such as reamer blades that can be retracted for removal of the drill string to get the next tubular string section to be advanced into the wellbore. The roller expander can be used instead of a cone type expander to get the various dimensions to build an end bell at a lower end and to expand the bulk of the string length as well as to secure the string to an existing tubular at an opposite end.

Top down expansion can also be accomplished with string weight added to the expander as an expansion option. In a bottom up expansion the movement of the expander can distribute the cement and while pushing up the cement take voids out of the cement.

Figure 18:
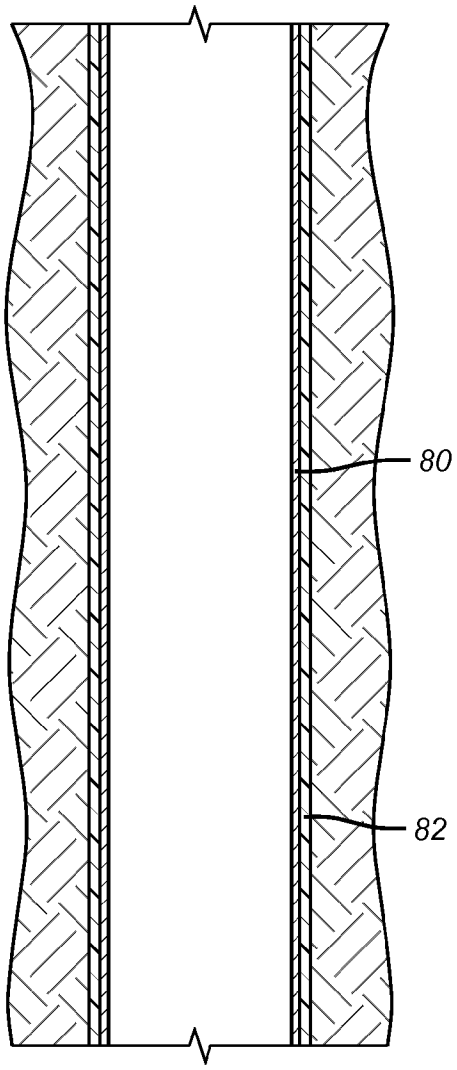
FIG. 18 is a section through a dual wall tubular that is not cemented.
Figure 17:
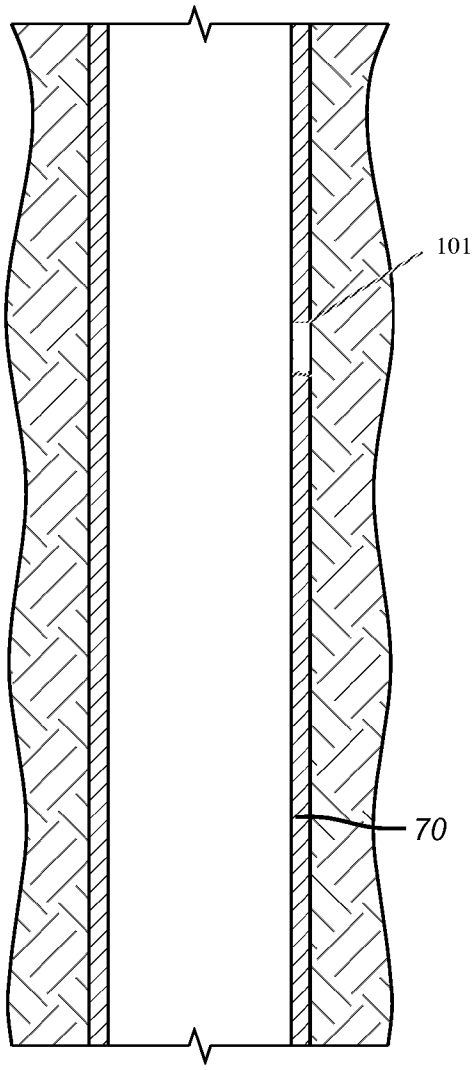
FIG. 17 is a section through a single wall tubular that is not cemented.
Figure 16:
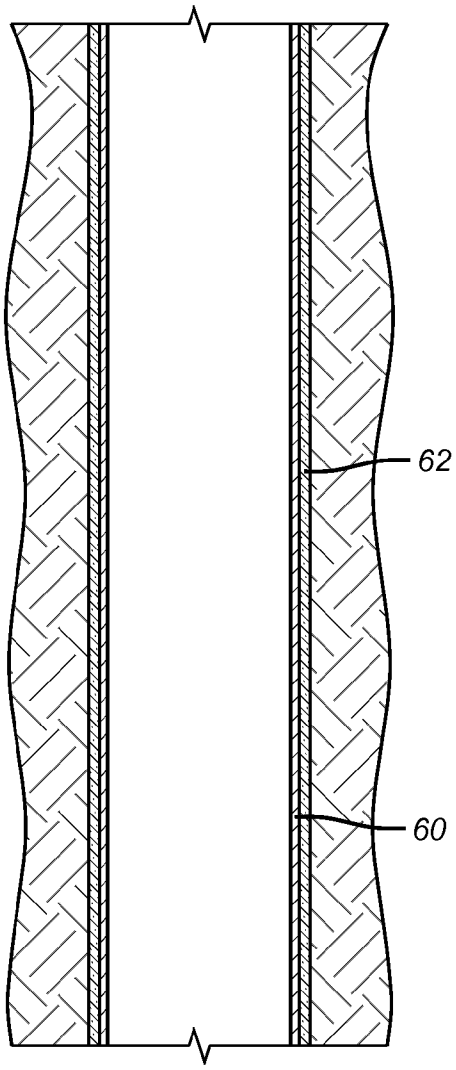
FIG. 16 is a section through a single wall cemented tubular.

A single wall tubular such as casing 60 can be used with cement 62 as shown in FIG. 16. FIG. 17 shows a single wall tubular 70 used without cement. FIG. 18 shows wall layers 80 and 82 where layer 82 is more ductile than layer 80 used in a borehole without cementing.

It is also desirable to rotate the tubular string 11 which can be done by rotation of the drill string if the drill string is rigid. The fluid motor 4 can also be selectively engaged to the tubular string with a swivel mount for the motor 4 to allow relative rotation as shown schematically by 54 in FIG. 15.

In the case of casing drilling the expander 6 can be carried within the casing and then when drilling to the needed depth the expander 6 can latch the bit 9 and be extended out the lower end of the casing so that it can be built and conduct the expansion bottom up while retrieving the bit and reamer behind it. Alternatively the expander 6 can be supported above the casing string using a running tool and an anchor with a stroker for expansion in a top down direction. The configuration for cementing can be as previously described.

Seals 12 or 15 can be inflatable seals actuated with the delivered cement 24.

"Cement" as used herein is intended to encompass all materials capable of sealing tubulars downhole.

Figure 19:
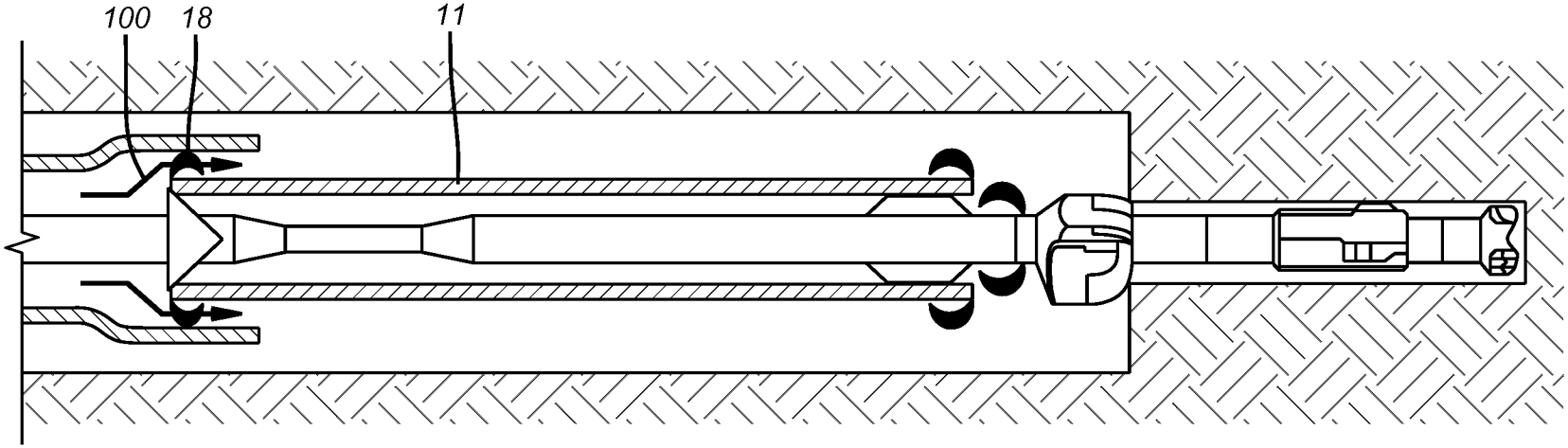
FIG. 19 is a section view illustrating the operation of the adjustable choke 18 shown in FIG. 3 with a previous casing in position.
Figure 20:
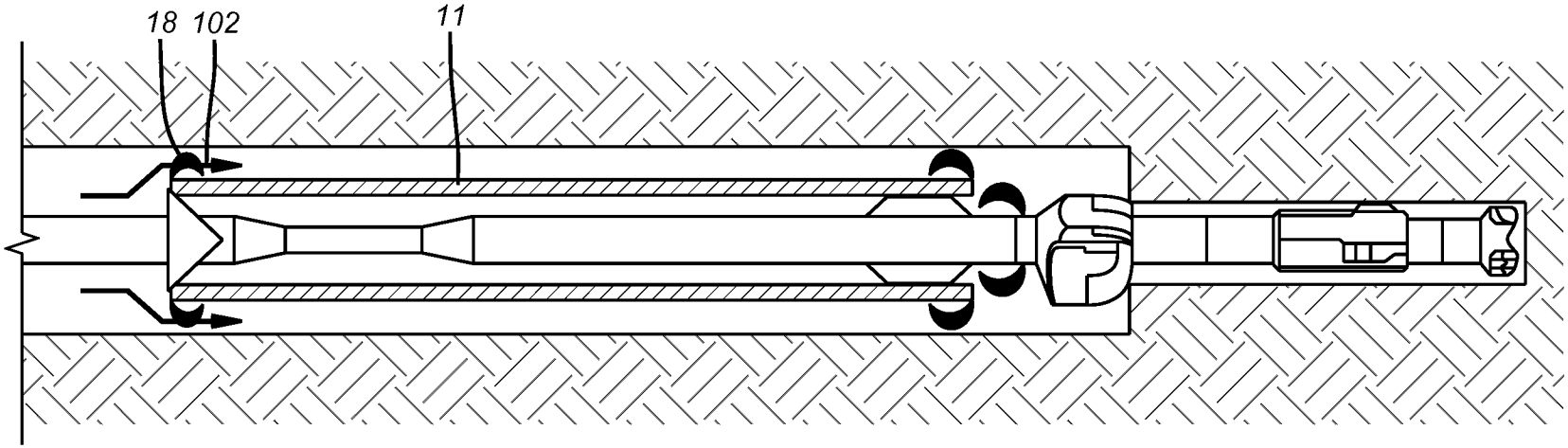
FIG. 20 is the view of FIG. 18 illustrating the adjustable choke in an open hole situation.

FIGS. 19 and 20 schematically show the one way flow action of the choke 18 within a bell at the lower end of an existing tubular as in FIG. 19 and arrows 100 or in open hole with arrows 102.

The above description is illustrative of the preferred embodiment and many modifications may be made by those skilled in the art without departing from the invention whose scope is to be determined from the literal and equivalent scope of the claims below:

We claim:

1. A drilling and completion method for extending a wellbore having an existing tubular string, comprising:

advancing an additional tubular string with a bit assembly as said bit assembly extends the wellbore;

expanding said additional tubular string into contact with said existing tubular string with an expansion assembly in the same trip as said advancing;

cementing said additional tubular string in the same trip as said advancing and said expanding;

isolating said bit assembly from cement delivered during said cementing;

delivering said cement to an annulus surrounding said additional tubular string;

providing an additional string seal in said annulus mounted to said additional string;

actuating said additional string seal with the delivered cement.

2. The method of claim 1, comprising:

creating a monobore with said existing and additional tubular.

3. The method of claim 1, comprising:

expanding said additional tubular to at least two internal dimensions.

4. The method of claim 1, comprising:

leaving a gap between said existing and additional tubular strings at a location of overlap between them during said cementing;

closing said gap after said cementing with said expanding.

5. The method of claim 1, comprising:

delivering said bit assembly and said additional string on a drill string;

mounting a drill string seal on said drill string to isolate cement delivered through said drill string from said bit assembly.

6. The method of claim 5, comprising:

actuating said drill string seal with the delivered cement.

7. The method of claim 6, comprising:

using a cup seal for at least one of said additional string and drill string seals.

8. The method of claim 5, comprising:

mounting a multi position expander assembly to said drill string;

making a bell at a lower end of said additional tubular string;

continuing expansion from said bell to secure said additional tubular string to a bell at a lower end of said existing tubular string.

9. The method of claim 8, comprising:

expanding said additional tubular string in a bottom up direction;

displacing cement in said annulus around said tubular string as the volume of said annulus is reduced from said bottom up direction of said expanding.

10. The method of claim 1, comprising:

providing pressure control on said additional tubular string to regulate fluid pressure at said bit assembly during said advancing.

11. The method of claim 10, comprising:

using at least one of an adjustable choke in an annulus surrounding said additional tubular string and at least one opening in said additional tubular string for said pressure control.

12. The method of claim 5, comprising:

providing a steering unit, a drill bit and a retractable reamer on said drill string as part of said bit assembly;

driving said drill bit with a fluid driven motor on said drill string;

moving said expansion assembly with a stroker while anchoring said drill string to the exiting tubular.

13. The method of claim 5, comprising:

providing a releasable running tool on said drill string;

using an indication tool on said drill string to orient the position of said running tool before securing the drill string to said additional tubular string with said running tool.

14. The method of claim 1, comprising:

providing said additional tubular string with a reduced non-circular profile during said advancing;

reforming the profile of said additional tubular string to circular during said expanding.

15. The method of claim 1, comprising:

performing said expanding with one of a multiple position conical swage, a roller expanded and internal pressure within said additional tubular string.

16. The method of claim 1, comprising:

continuing extending the wellbore by repeating said advancing, expanding and cementing steps as further additional strings are supported in the wellbore to said additional string just previously delivered.

17. The method of claim 5, comprising:

moving a swage attached to said drill string with a force delivered through said drill string;

providing an anchor and a stroker to move said swage as a backup to said force delivered through said drill string.

18. The method of claim 1, comprising:

providing at least one of, slots in said additional tubular string or multiple wall layers of differing ductility.

* * * * *